US008191816B2

(12) United States Patent
Kaminaka

(10) Patent No.: US 8,191,816 B2
(45) Date of Patent: Jun. 5, 2012

(54) ROLL-SHEET FEEDING DEVICE AND IMAGE FORMING APPARATUS

(75) Inventor: Motoyuki Kaminaka, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 229 days.

(21) Appl. No.: 12/453,104

(22) Filed: Apr. 29, 2009

(65) Prior Publication Data

US 2009/0272838 A1 Nov. 5, 2009

(30) Foreign Application Priority Data

Apr. 30, 2008 (JP) ..... 2008-118733
May 8, 2008 (JP) ..... 2008-122123

(51) Int. Cl.
*B65H 23/06* (2006.01)

(52) U.S. Cl. ..... 242/422; 242/422.4; 242/598

(58) Field of Classification Search ..... 242/422, 242/422.2, 422.4, 598
See application file for complete search history.

(56) References Cited

U.S. PATENT DOCUMENTS 3,644,930 A * 2/1972 Stange et al. ..... 347/152
5,388,923 A * 2/1995 Dubois et al. ..... 400/613.1
5,709,481 A * 1/1998 Hinojosa et al. ..... 384/219
5,974,963 A * 11/1999 Kawai ..... 101/128.1

FOREIGN PATENT DOCUMENTS

JP 56-104741 8/1981
JP 2951951 7/1999
JP 2002-187646 7/2002
JP 3454227 7/2003
JP 2006-315777 11/2006

OTHER PUBLICATIONS

Abstract of JP 11-152111 published Jun. 8, 1999.
Abstract of JP 2001-316007 published Nov. 13, 2001.

* cited by examiner

*Primary Examiner* — Sang Kim
(74) *Attorney, Agent, or Firm* — Harness, Dickey & Pierce, P.L.C.

(57) ABSTRACT

A roll-sheet feeding device stores therein a roll sheet, rotates the roll sheet in an unwinding direction, and feeds the roll sheet. The roll-sheet feeding device includes a jumping preventing unit that suppresses a jumping of the roll sheet when feeding the roll sheet in the unwinding direction by applying a predetermined load to the roll sheet from both sides of the roll sheet.

16 Claims, 13 Drawing Sheets

ROLL-SHEET FEEDING DEVICE AND IMAGE FORMING APPARATUS

CROSS-REFERENCE TO RELATED APPLICATIONS

The present application claims priority to and incorporates by reference the entire contents of Japanese priority document 2008-118733 filed in Japan on Apr. 30, 2008 and Japanese priority document 2008-122123 filed in Japan on May 8, 2008.

BACKGROUND OF THE INVENTION

1. Field of the Invention

The present invention relates to a roll-sheet feeding device that unwinds and feeds a roll sheet wound in a roll, and an image forming apparatus employing the roll-sheet feeding device.

2. Description of the Related Art

Conventionally, it is known that a roll-sheet feeding device is provided in an image forming apparatus such as a multi-function product including such functions as a copier, a printer, and a facsimile, or including at least two of the functions, and that a roll sheet is used therein as a transfer material. In this type of roll-sheet feeding device, the roll sheet is rotatably supported through a spool or the like, and when the roll sheet is to be fed, a trailing edge thereof is pulled by a feeding unit, the roll rotates, and the roll sheet is unwound. At the time of feeding the roll sheet, if the roll sheet inertially rotates due to feed acceleration and inertia force so that a portion more than that required for a fed portion is unwound, slack occurs in the roll sheet. This phenomenon depends on a paper feed speed and an outer diameter/mass of the roll, and the inertia force particularly increases and the slack thereby increases under such conditions that paper feed acceleration is high, an outer diameter of the roll sheet is large, a sheet width is wide, and density of the sheet is high. When the slack occurs, then nonuniform stripes and black stripes occur at a nip portion due to an abrupt change in tension force causing the sheet being fed to be skewed, which causes image quality to be degraded. Therefore, the roll-sheet feeding device is usually provided with a brake mechanism, which prevents the slack in the roll sheet.

As a conventional brake mechanism, Japanese Patent Application Laid-open No. 2006-315777 discloses a brake mechanism that stops rotation of a spool shaft through a torque limiter or a spring member for applying torque to rotation thereof in a rewinding direction of a roll sheet, provided in one end side of the spool shaft.

However, the brake mechanism disclosed in Japanese Patent Application Laid-open No. 2006-315777 has some problems that high torque load always occurs in a motor.

In a roll-sheet feeding device in this conventional technology, a bearing provided in the spool shaft is supported by a U-groove formed in a roll sheet holder allowing for operability upon replacement of the roll sheet. In this structure, when the roll sheet is pulled out, jumping force is biased to the roll sheet, so that the roll sheet almost jumps out of the U-groove. Particularly, in recent high-speed machines, because high jumping force is added to the roll sheet, any countermeasure against this problem is required.

It is considered to provide an appropriate locking unit, as the countermeasure, so that the spool shaft inserted into the U-groove does not jump out of the groove. However, if the locking unit is provided, then this requires a lock operation and an unlock operation upon replacement of the roll sheet, which causes the operability to be extremely worsened.

Moreover, in the roll-sheet feeding device, the roll sheet to be supported is getting lighter in weight by being used over time. At this time, because brake force of the brake mechanism is designed for a roll sheet that has nearly the largest diameter, back tension more than required is applied to the roll sheet when it becomes lighter in weight. Therefore, it is desired that the brake force of the brake mechanism can be also automatically adjusted according to a weight of the roll sheet.

However, in the roll-sheet feeding device according to Japanese Patent Application Laid-open No. 2006-315777, the brake force is always constant, and therefore, the brake force cannot be appropriately adjusted according to conditions.

A roll-sheet feeding device that can appropriately adjust the brake force according to conditions is disclosed in Japanese Patents No. 3454227 and 2951951. A technology disclosed in Japanese Patent No. 3454227 allows the brake force to be appropriately adjusted because the torque works by own weights of a flange and the roll sheet. However, when an outer diameter of the roll sheet is small i.e. its width is narrow under a high-speed condition, then the flange jumps, so that the rotation cannot be stopped by using friction between the roller and the flange, and a brake does not thereby work. A technology disclosed in Japanese Patent No. 2951951 allows the brake force to be optimally adjusted, however, an angle sensor and an electromagnetic brake are provided to control the brake force, which leads to an increase in cost.

SUMMARY OF THE INVENTION

It is an object of the present invention to at least partially solve the problems in the conventional technology.

According to one aspect of the present invention, there is provided a roll-sheet feeding device that stores therein a roll sheet, rotates the roll sheet in an unwinding direction, and feeds the roll sheet. The roll-sheet feeding device includes a jumping preventing unit that suppresses a jumping of the roll sheet when feeding the roll sheet in the unwinding direction by applying a predetermined load to the roll sheet from both sides of the roll sheet.

Furthermore, according to another aspect of the present invention, there is provided a roll-sheet feeding device that stores therein a roll sheet, rotates the roll sheet in an unwinding direction, and feeds the roll sheet. The roll-sheet feeding device includes a jumping preventing means for suppressing a jumping of the roll sheet when feeding the roll sheet in the unwinding direction by applying a predetermined load to the roll sheet from both sides of the roll sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
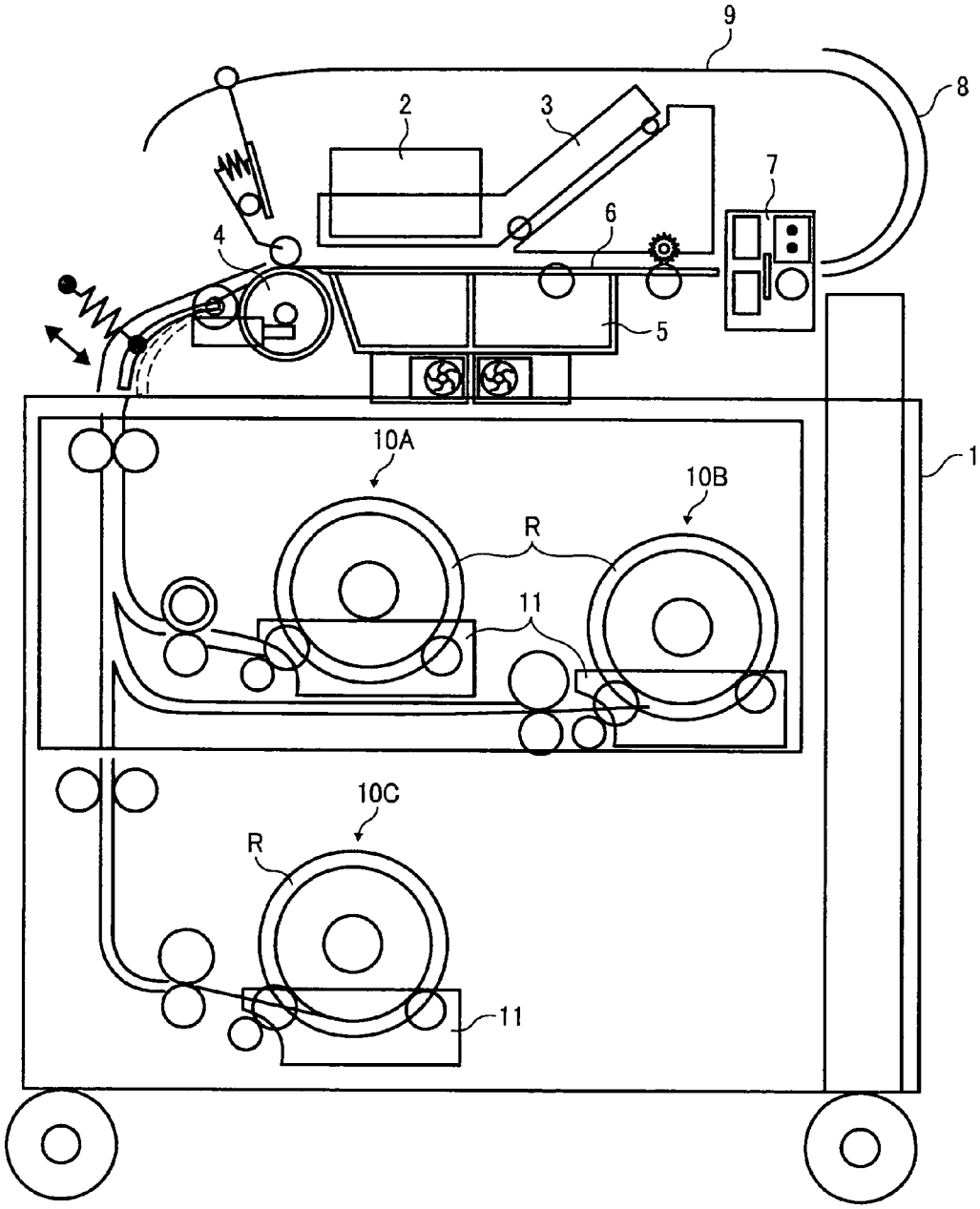
FIG. 1 is a schematic cross-section of an example of an image forming apparatus provided with a roll-sheet feeding device according to the present invention.

FIG. 1 is a schematic of an image forming apparatus provided with a roll-sheet feeding device 10 according to a first embodiment of the present invention. The image forming apparatus is an ink-jet printer that receives data from, for example, a computer aided design system (CAD) (not shown), reciprocates a carriage 3 with a head 2, and forms an image.

In FIG. 1, three roll-sheet feeding devices 10A, 10B, and 10C are provided in a housing 1 of the printer. Roll sheets R with a different paper width are set in the roll-sheet feeding devices 10A, 10B, and 10C respectively so that printing for various sizes can be performed, or roll sheets R with the same width as each other are set therein so that a time loss due to a shortage of sheets can be eliminated. A trailing edge of the roll sheet in one of the three roll-sheet feeding devices 10A, 10B, and 10C is located at a registration roller 4 provided in the upstream side of the head 2, while trailing edges of roll sheets of the other roll-sheet feeding devices stay at waiting positions (not shown). When printing is started and the roll sheet R to be used is located at the registration roller 4, the printing is performed as it is. However, when one of the other roll sheets R is selected, the roll sheet located at the registration roller 4 is rewound to the waiting position, the selected roll sheet is output, and the printing is started when the selected roll sheet reaches the registration roller 4.

Upon starting of the printing, the roll sheet R is conveyed while being attracted to a support plate 6 by a sheet attracting unit 5, and by causing the carriage 3 with the head 2 to reciprocate based on data sent from CAD during the conveyance, the printing is performed. When the printing is finished, the roll sheet R is cut to predetermined length by a cutter 7 and is ejected to a paper ejection tray 9 through a reverse guide 8.

Next, the roll-sheet feeding device 10 is explained below. It is noted that the image forming apparatus according to the present invention has the three roll-sheet feeding devices 10A, 10B, and 10C which are identically configured, and thus, when they are commonly explained, the letters "A", "B", and "C" added to "10" are omitted.

Figure 2:
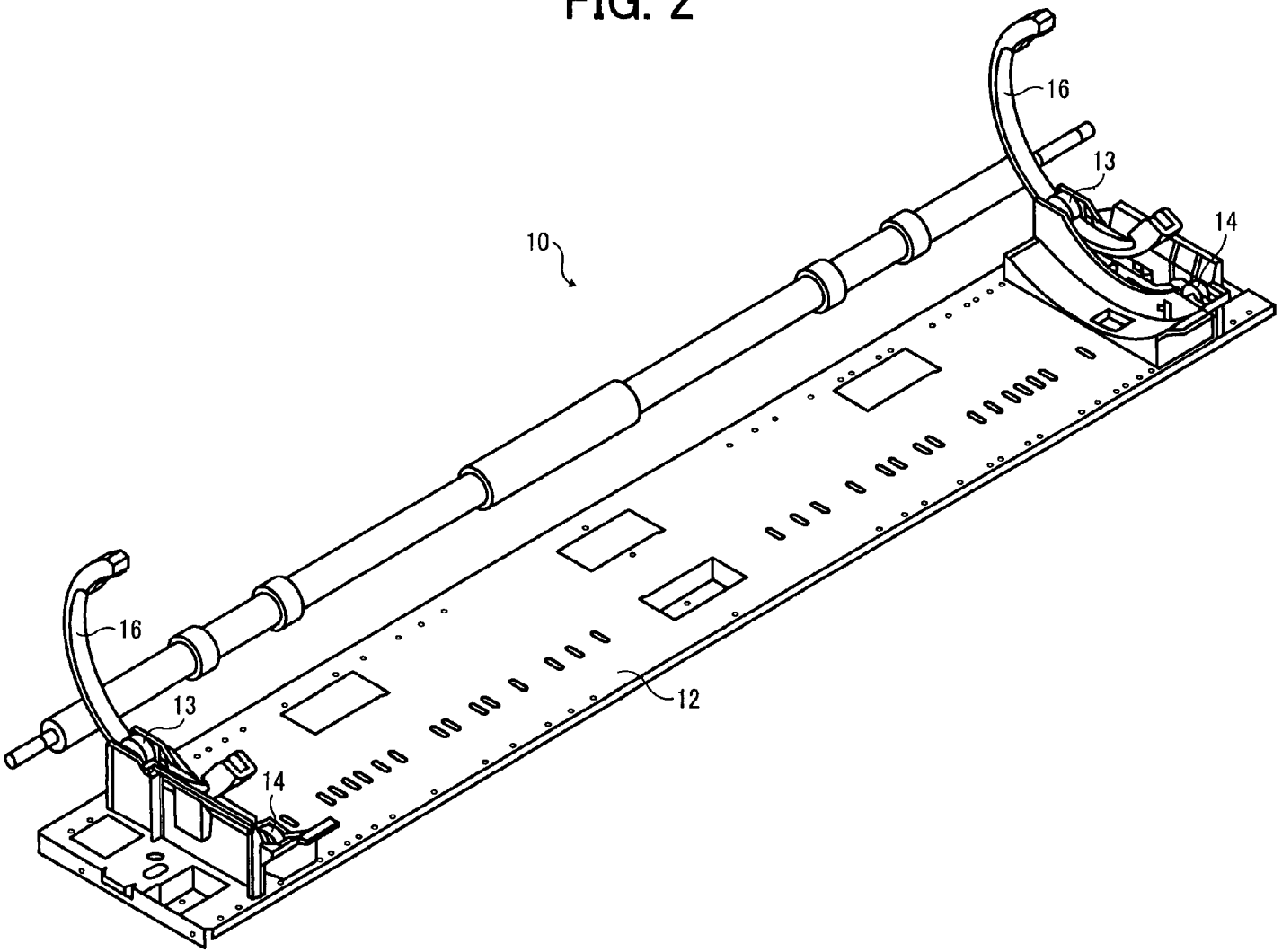
FIG. 2 is a perspective view of a roll-sheet feeding device according to a first embodiment of the present invention when a roll sheet is removed therefrom.
Figure 3:
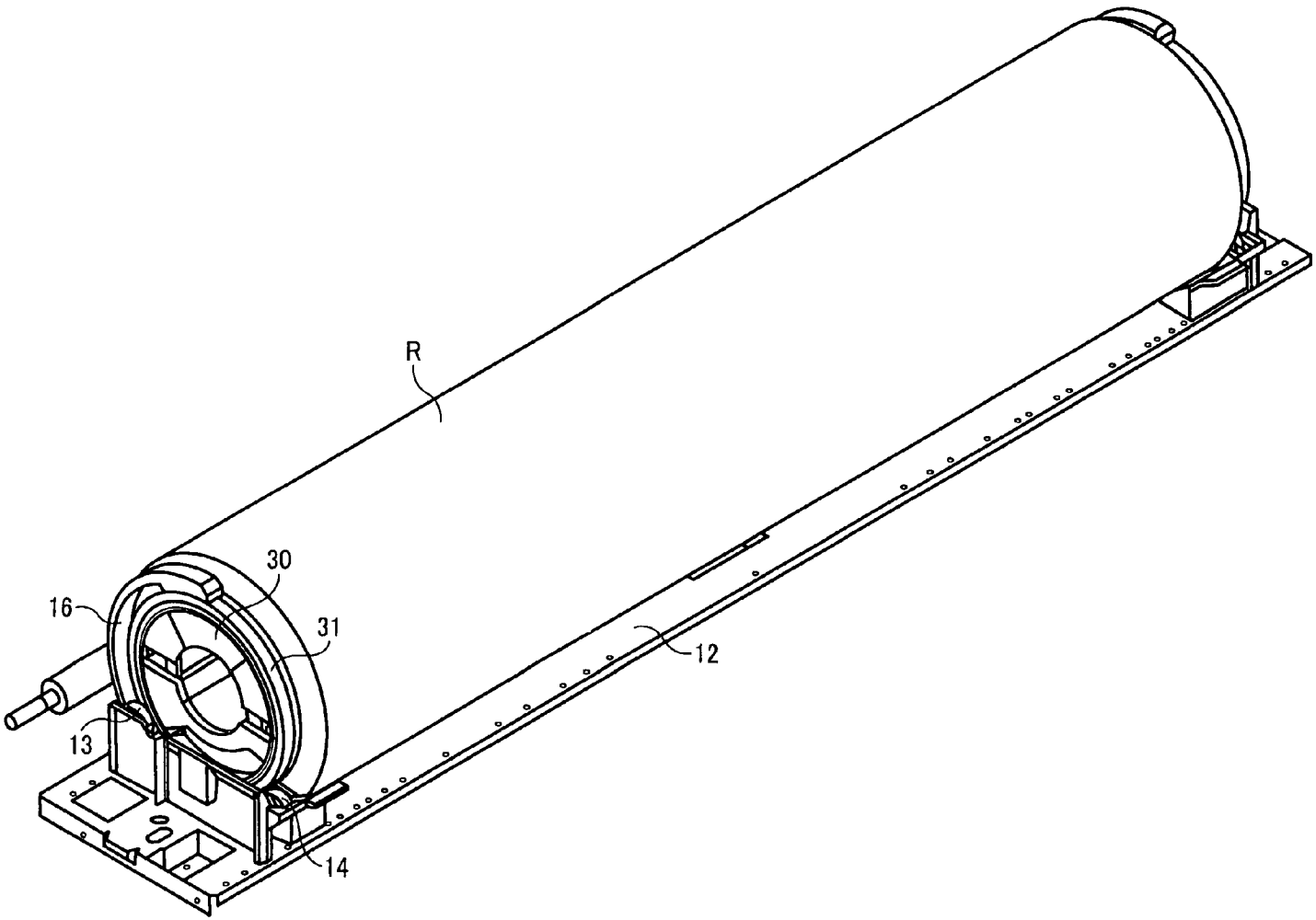
FIG. 3 is a perspective view of the roll-sheet feeding device according to the first embodiment when the roll sheet is set therein.

As shown in FIG. 1, the roll-sheet feeding device 10 includes a roll tray 11 which is supported so as to be slidable through a slide unit (not shown) between a sheet feeding position inside the housing 1 and a roll-sheet replacing position outside the roll tray 11. As shown in FIG. 2, the roll tray 11 has a bottom plate 12 formed into a narrow rectangle. Arranged at both sides of the bottom plate 12 in its longitudinal direction are supporting units that support the roll sheet R and actuation arms 16 which are working members actuated by the roll sheet R that is set. Meanwhile, the roll sheet R includes a hollow core tube (not shown) and a sheet wound around the core tube. As shown in FIG. 3, a flange 30 as a circular member is fixed to both sides of the core tube. It is noted that the roll sheet R is inserted into the roll tray 11 vertically from above as indicated by arrow in FIG. 4 so as to be set in a position where a sheet can be output, namely, in a sheet feeding position.

The supporting unit includes support rollers 13 and 14 that support an outer peripheral portion 31 of the flange 30 of the roll sheet R which is set in the sheet feeding position. Each axis line of the support rollers 13 and 14 is parallel to an axis line of the roll sheet R, and one of the support rollers 13 and 14 is a drive roller and the other is a driven roller.

The actuation arm 16 is formed in an arc shape. Specifically, a load applying unit 17 that applies load to rotation of the roll sheet R through the flange 30 is provided in the upper end of the actuation arm 16 in FIG. 4. A brake pad 17A is fixed to a surface of the load applying unit 17 opposed to the flange 30. A radius of the arc of the actuation arm 16 is formed slightly larger than a radius of the outer periphery of the flange 30, so that the actuation arm 16 is provided rotatably through a shaft 13A of the support roller 13. It is noted that if the radius of the arc of the actuation arm 16 is too large, then an unnecessary space is produced. Therefore, the radius of the arc is preferably set to about 120% of the radius of the outer periphery of the flange 30.

Thus, the arc-shaped actuation arm 16 is swingable between the waiting position and a holding position where the actuation arm 16 is held, based on the shaft 13A of the support roller 13 as a support point. An upper portion of the actuation arm 16 is longer and heavier than those of a lower portion thereof based on the shaft 13A. Therefore, when the roll sheet R is removed therefrom, the actuation arm 16 rotates leftward (counterclockwise in FIG. 4) under its own weight, and is held by a stopper (not shown) at the waiting position indicated by dotted line in FIG. 4.

Figure 4:
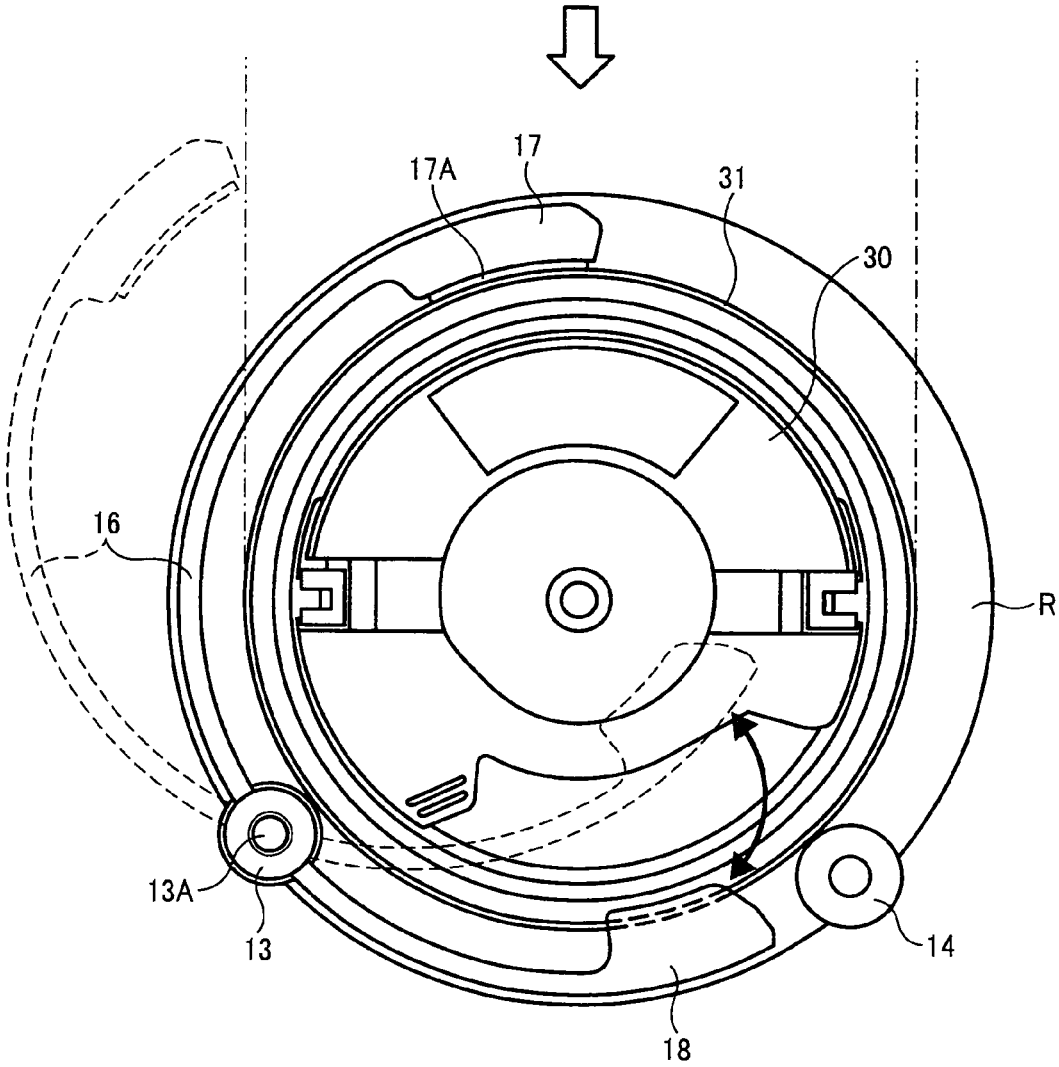
FIG. 4 is a schematic for explaining how to set the roll sheet in the roll-sheet feeding device according to the first embodiment.

The other end of the actuation arm 16 i.e. the lower end thereof in FIG. 4 has a receiving portion 18 that receives the outer peripheral portion 31 of the flange 30 in the roll sheet R set in the sheet feeding position. When the actuation arm 16 is located at the waiting position, the receiving portion 18 enters an area, which is supposed to be occupied by the flange 30 of the roll sheet R when it is set, as indicated by the dotted line in FIG. 4. Moreover, because the receiving portion 18 and the load applying unit 17 inwardly project in the radius of the actuation arm 16, the receiving portion 18 and the brake pad 17A of the load applying unit 17 provided in the actuation arm 16 located at the holding position come into contact with the flange 30. When the roll sheet R is set in the sheet feeding position, the receiving portion 18 of the actuation arm 16 is pushed downward by the flange 30. With this operation, the actuation arm 16 rotates clockwise in FIG. 4 around the shaft 13A, and the load applying unit 17 comes into contact with the outer peripheral portion 31 of the flange 30. Thus, the brake pad 17A of the load applying unit 17 can apply load to the rotation of the roll sheet R.

The roll-sheet feeding device 10 configured in the above manner enables the load applying unit 17 to come into contact with the outer peripheral portion 31 of the flange 30 at one action at which the roll sheet R is set in the sheet feeding position, and this allows improvement of operability. It is noted that in the actuation arm 16 located at the waiting position, an end portion in the side where the load applying unit 17 is provided is located at a position outward from an area, indicated by dashed one-dotted lines in FIG. 4, where the flange 30 of the roll sheet R passes. Thus, the flange 30 does not damage the setting of the roll sheet R caused by the contact thereof with the actuation arm 16 when the roll sheet R is to be set in the sheet feeding position.

Figure 5:
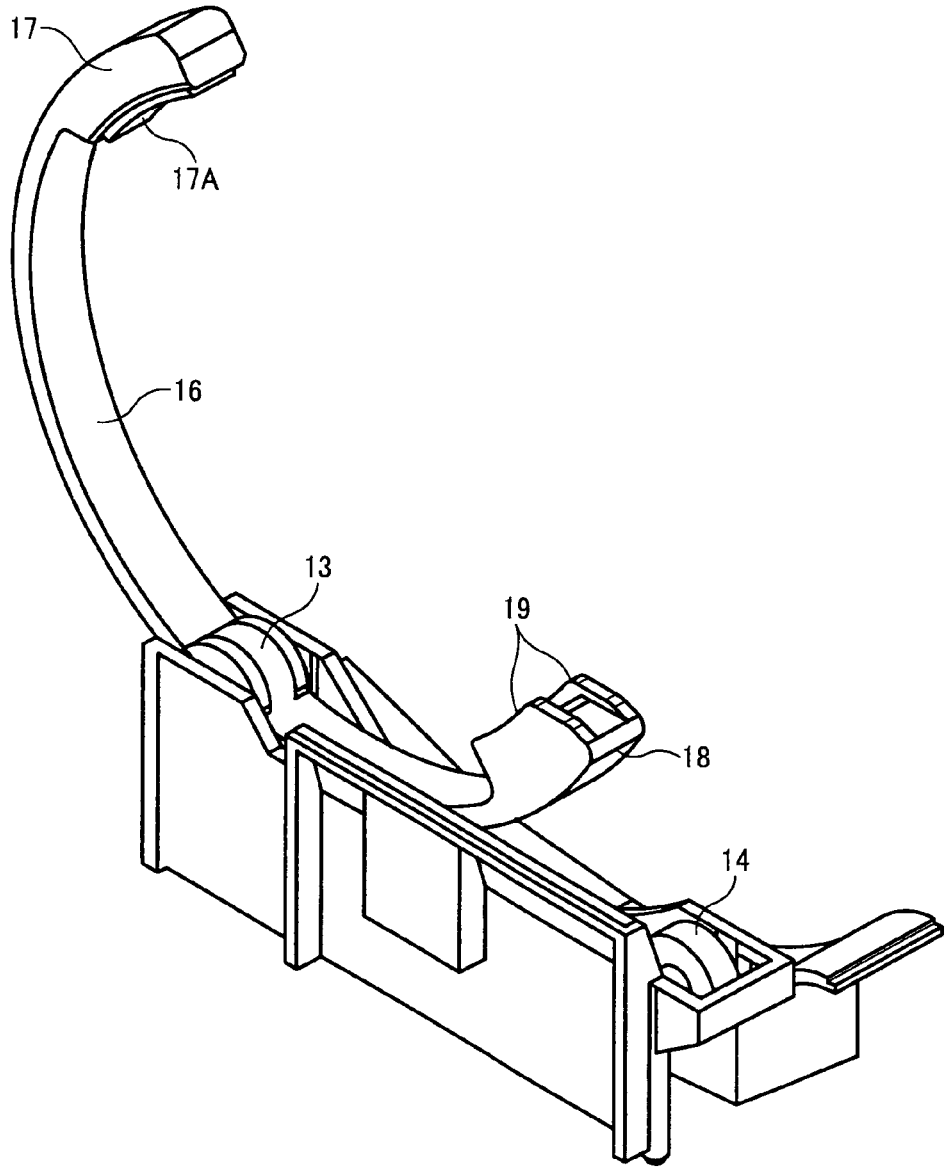
FIG. 5 is a perspective view of an actuation arm according to the first embodiment.

Furthermore, as shown in FIG. 5, a guide member 19 for guiding the flange 30 in contact therewith is provided in the receiving portion 18 of the actuation arm 16. By providing the guide member 19 therein, a cross section of the receiving portion 18 in the shaft direction of the roll sheet R is formed into a concave shape, and the outer peripheral portion 31 of the flange 30 is received by its concave portion, so that the roll sheet R can be set horizontally.

Figure 6:
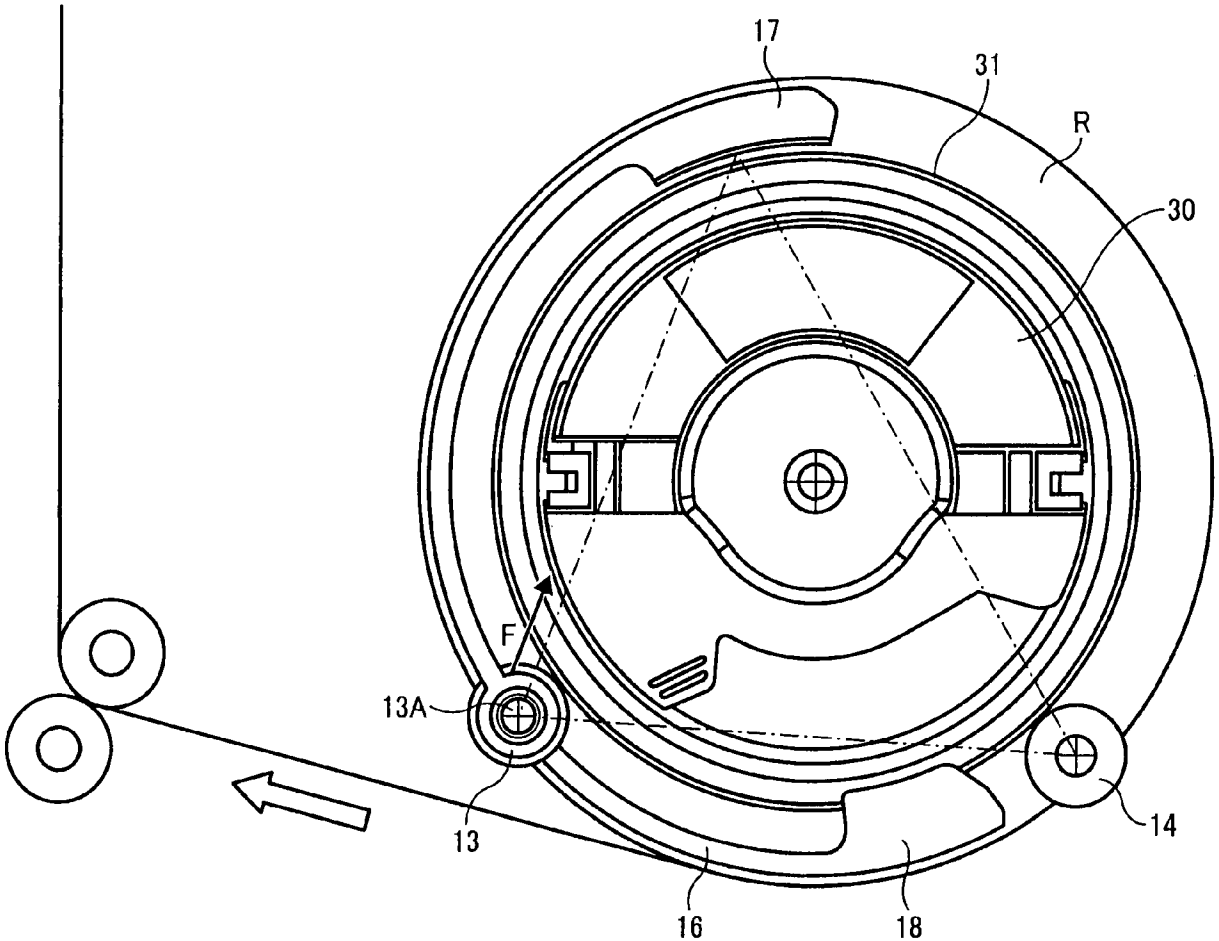
FIG. 6 is a schematic for explaining a positional relationship between a support roller and a load applying unit according to the first embodiment.

As shown in FIG. 4 and others, in the roll-sheet feeding device 10 according to the first embodiment, the roll sheet rotates clockwise, and the sheet is unwound from the lower side of the roll sheet and is fed. When the sheet is fed, the flange 30 undergoes such force that the flange 30 may jump to the upper right, as indicated by arrow F in FIG. 6, based on a contact point with the support roller 14 as a support point, so that a set state of the roll sheet may be released. At this time, in the roll-sheet feeding device 10, because the load applying unit 17 is located at a position in which jumping force of the flange 30 is received, it is possible to prevent the actuation arm 16 from moving in the counterclockwise based on the shaft 13A, as the support point, of the support roller 13 occurring due to impact of the jumping of the flange 30. As shown in FIG. 6, if the holding position is set so that a center C of the flange 30 falls within a triangle formed by connecting the load applying unit 17, the shaft 13A (support point) of the support roller 13, and the shaft of the support roller 14, the roll sheet can be more stably held through the flange 30.

Figure 7:
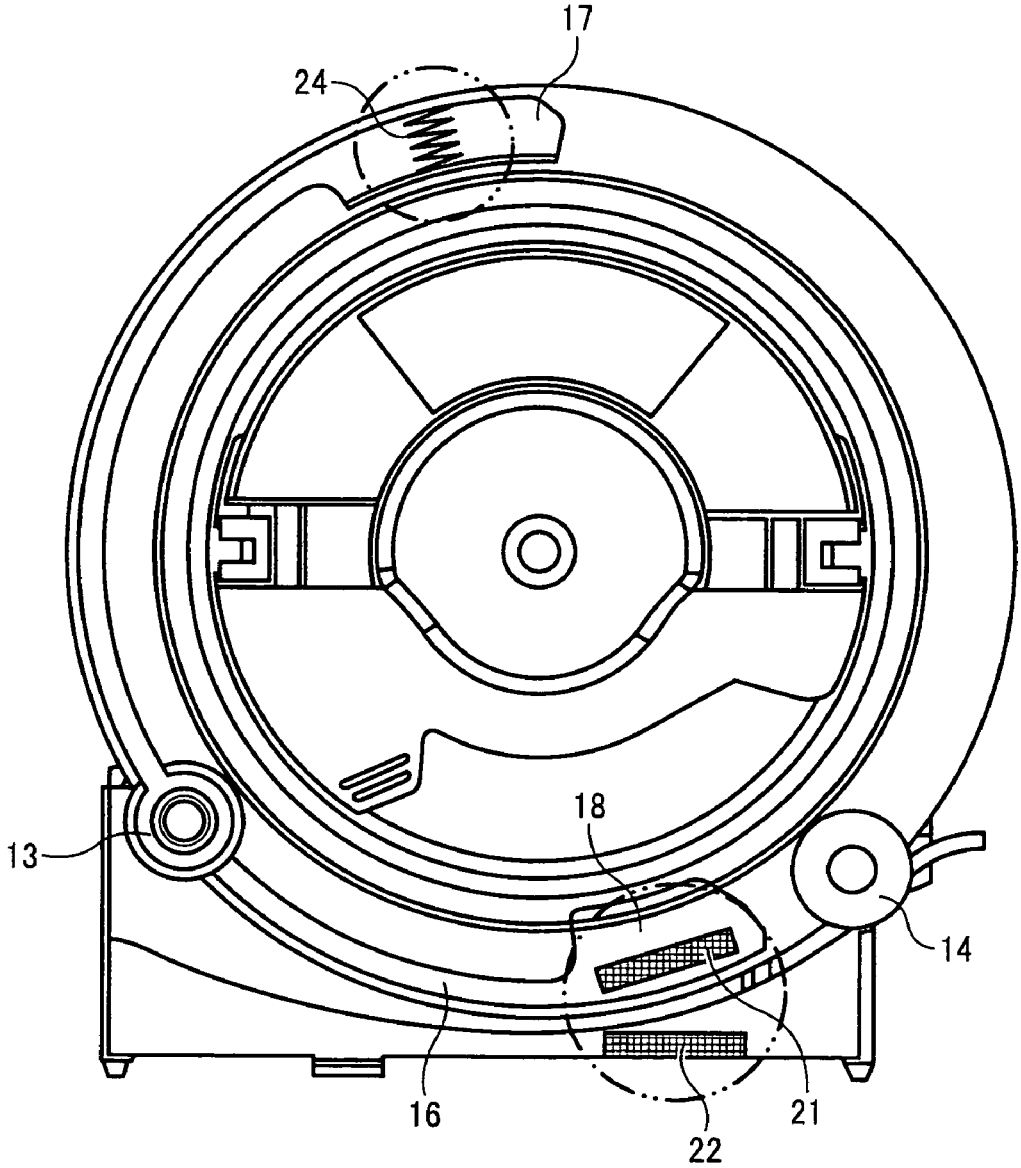
FIG. 7 is a perspective view of a first modification of the roll-sheet feeding device according to the first embodiment.

FIG. 7 is a perspective view of a first modification of the roll-sheet feeding device according to the first embodiment. Magnets 21 and 22 are placed so as to attract the receiving portion 18 and a receiving plate (not shown) of the roll tray 11, respectively. These magnets 21 and 22 enable the actuation arm 16 to be prevented from its moving around the shaft of the support roller 13 due to the impact of the jumping of the flange 30.

As explained above, when the trailing edge of the roll sheet in the roll-sheet feeding device 10, for example, the roll-sheet feeding device 10A according to the first modification reaches the position of the registration roller 4, and if any other roll-sheet feeding device 10, for example, the roll-sheet feeding device 10B is selected, the roll-sheet feeding device 10A rewinds the roll sheet to the waiting position. The support roller 14 is formed of a drive roller that is driven by a drive unit (not shown), and the roll sheet R is rewound by driving the support roller 14 through the flange 30. Upon the rewind, because the brake pad 17A of the load applying unit 17 contacts the flange 30, the load is continuously applied to rotation of the flange 30 during rewinding and conveying of the roll sheet.

Figure 8:
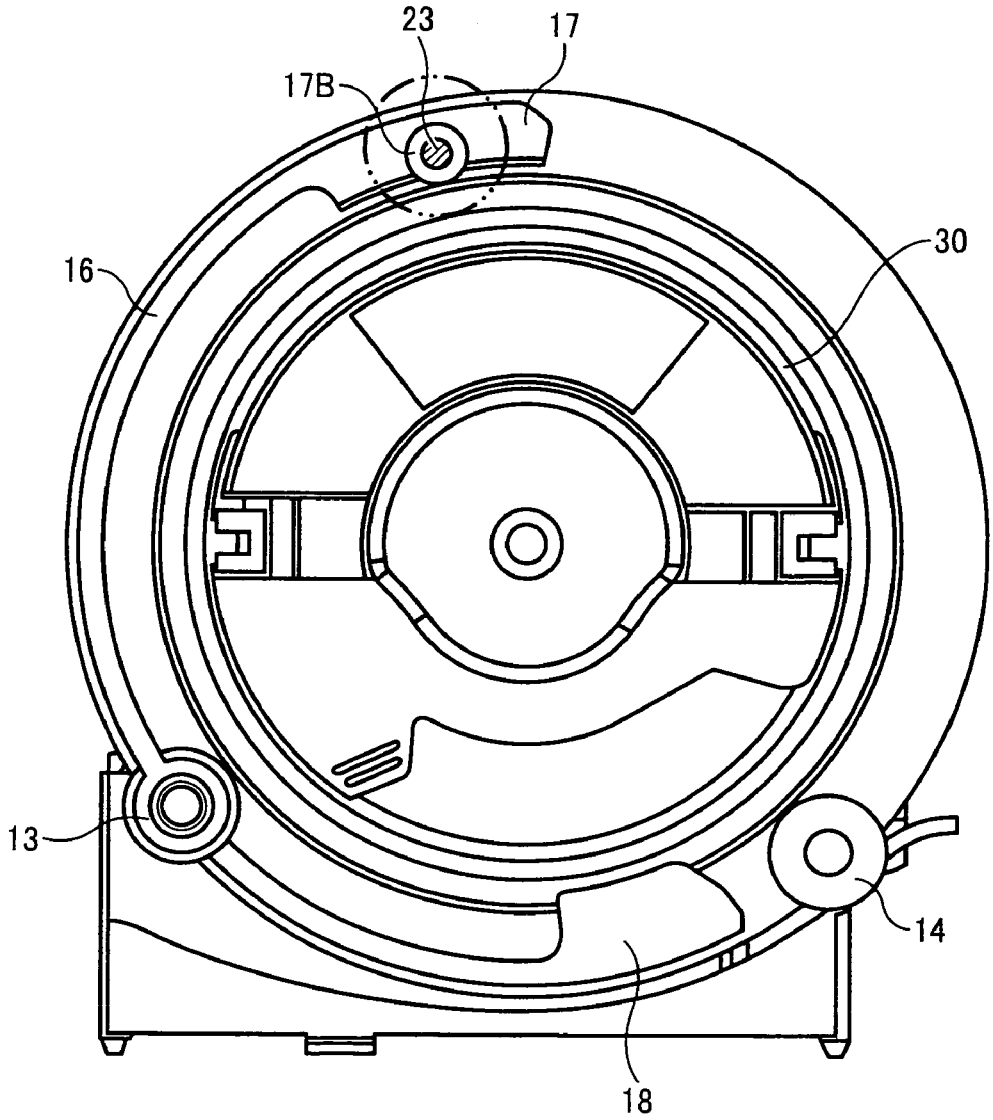
FIG. 8 is a perspective view of a second modification of the roll-sheet feeding device according to the first embodiment.

FIG. 8 is a perspective view of a second modification of the roll-sheet feeding device according to the first embodiment. In the second modification of FIG. 8, a brake roller 17B instead of the brake pad 17A is placed on the load applying unit 17 of the actuation arm 16 through a one-way clutch 23. When the roll sheet R is to be fed, the one-way clutch 23 locks and the brake roller 17B applies rotational load to the outer periphery of the flange 30, while when the roll sheet R is to be rewound, the one-way clutch 23 is unlocked, so that a carrying load of the drive unit can be reduced.

As another method of reducing the carrying load of the drive unit when the roll sheet R is to be rewound, an electromagnet is placed instead of the brake pad 17A, iron is wound around the outer periphery of the flange 30, and brake force can be controlled so as to be released at timing of on/off of the electromagnet.

As shown in FIG. 7, in the roll-sheet feeding device 10 according to the first modification, a compression spring 24 as an elastic member is placed inside the load applying unit 17, and a contact pressure between the brake pad 17A and the flange 30 is controlled, so that rotational load force can be controlled. In this case, if spring pressure of the compression spring 24 is made strong, excellent brake force can be obtained, however, if the spring pressure is too strong, this causes an increase in the carrying load of the drive unit. Therefore, it is appropriate that a spring pressure according to an inertia force of the flange 30 is selected based on a feeding speed of the roll sheet R and a type of the sheet such as an outer diameter and a width of the roll sheet R.

Next, the roll-sheet feeding device 10 according to a second embodiment of the present invention is explained below. An image forming apparatus according to the second embodiment has the three roll-sheet feeding devices 10A, 10B, and 10C, which are configured in the same manner as the first embodiment, and thus, when they are commonly explained, the letters "A", "B", and "C" added to "10" are omitted.

Figure 9:
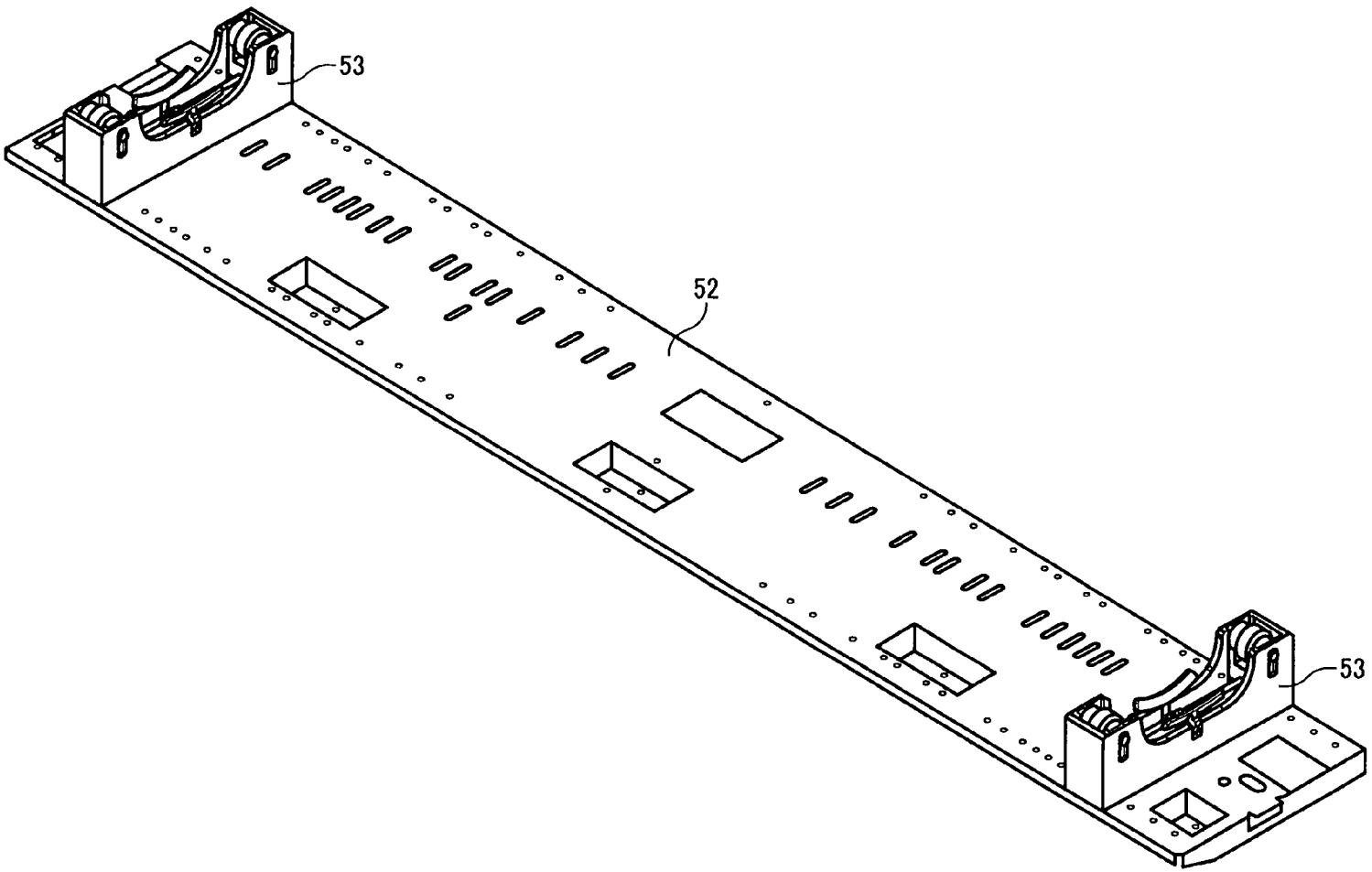
FIG. 9 is a perspective view of a roll-sheet feeding device according to a second embodiment of the present invention when a roll sheet is removed therefrom.
Figure 10:
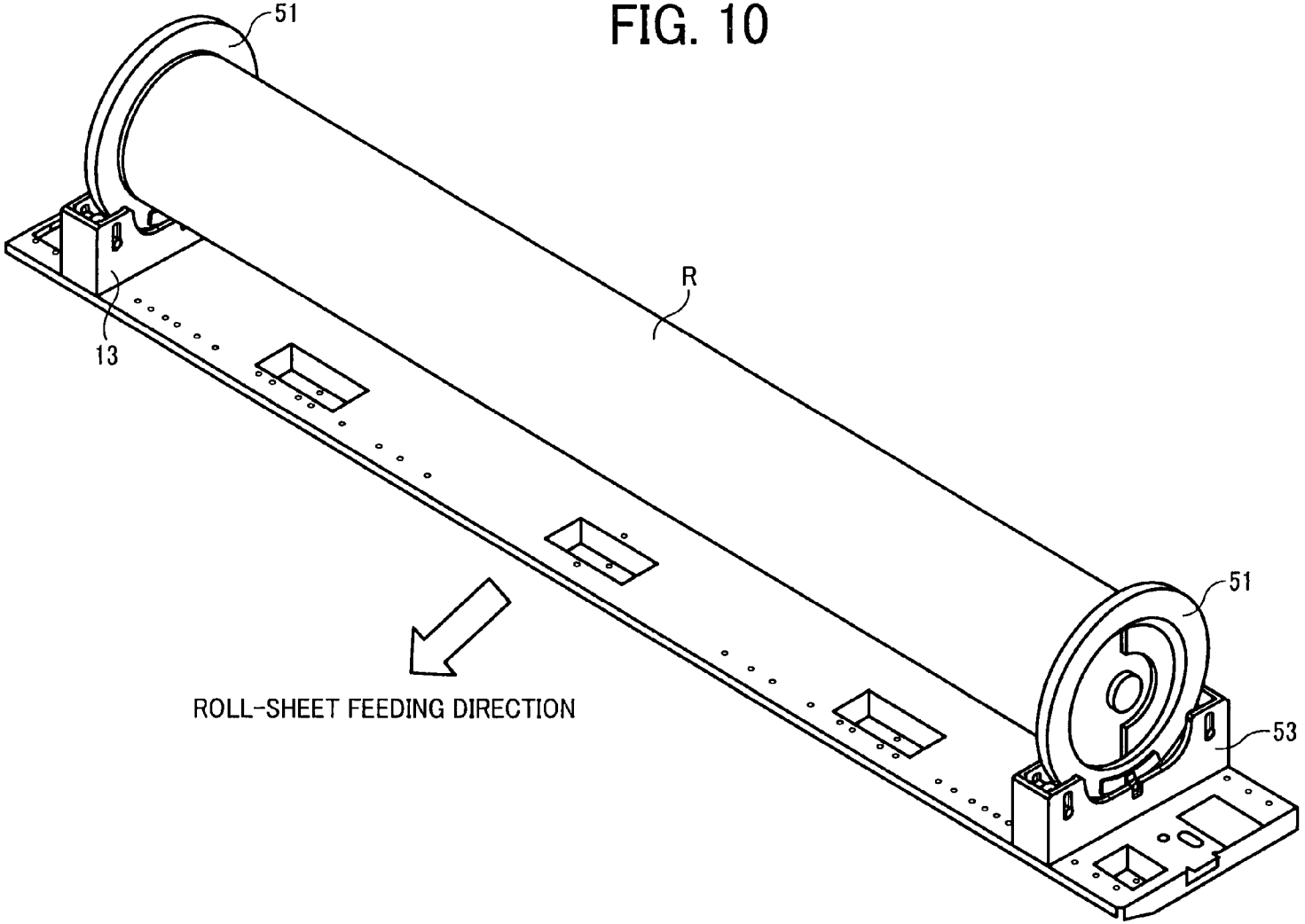
FIG. 10 is a perspective view of the roll-sheet feeding device according to the second embodiment when the roll sheet is set therein.
Figure 11:
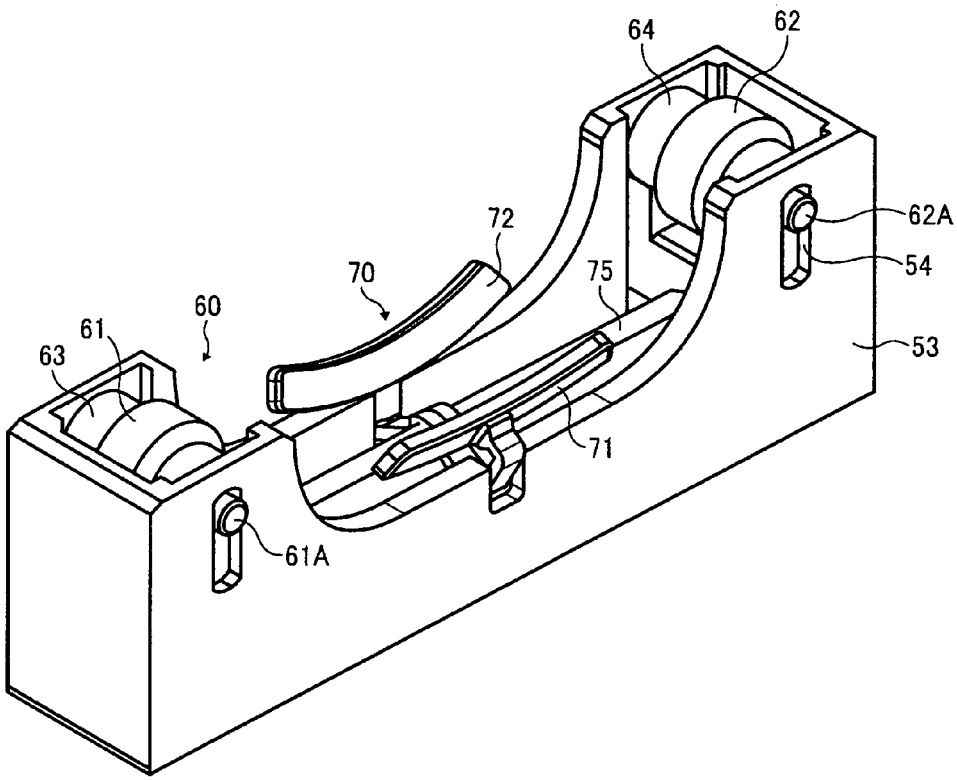
FIG. 11 is a perspective view of a receiving member of the roll-sheet feeding device according to the second embodiment.

FIGS. 9 to 11 are perspective views of the roll-sheet feeding device according to the second embodiment.

The roll sheet R in FIGS. 9 to 11 includes a hollow core tube (not shown) and a sheet wound around the core tube. As shown in FIG. 10, a flange 51 as a disk member is attached to both sides of the core tube. A supporting unit that supports the roll sheet R includes a bottom plate 52 formed into a narrow rectangle. Arranged at both sides of the bottom plate 52 in its longitudinal direction are receiving members 53 that are formed into a frame and receive the flange 51 attached to the roll sheet R. Arranged inside the receiving member 53 are, as shown in FIG. 11, a supporting unit 60 that rotatably supports the roll sheet R in winding and unwinding directions and a load applying unit 70 that applies load to the rotation of the set roll sheet R.

Figure 12:
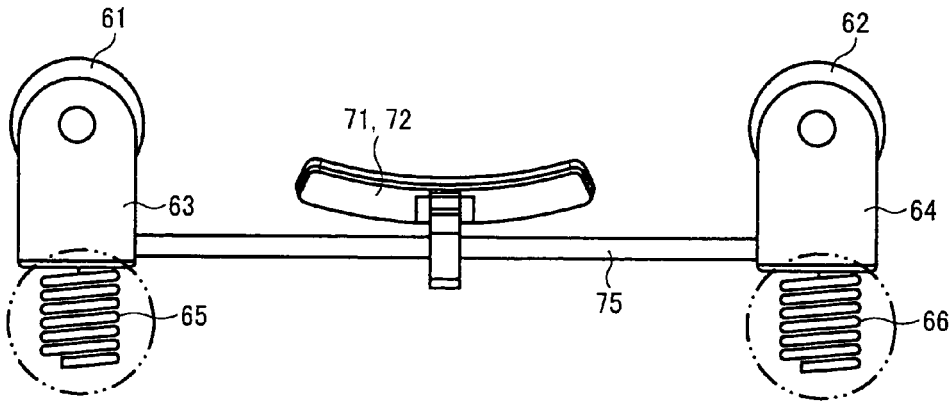
FIG. 12 is a schematic for explaining a waiting position of the roll-sheet feeding device according to the second embodiment.

As shown in FIGS. 11 and 12, the supporting unit 60 has support rollers 61 and 62 on which the surface of the flange 51 attached to the roll sheet R is seated. The support rollers 61 and 62 are rotatably supported by roller holders 63 and 64, respectively, and roller shafts 61A and 62A are fitted in guide holes 54 formed on the side of the receiving member 53. The guide hole 54 is formed into a long hole in a vertical direction i.e. in a vertically extending direction with respect to the face of the bottom plate 52, and the support rollers 61 and 62 are thereby movably supported in the vertical direction. Moreover, compression springs 65 and 66 are provided inside the receiving member 53 so as to bias elastic force in a direction in which the support rollers 61 and 62 are always pushed upward through the roller holders 63 and 64, respectively. The compression springs 65 and 66 allow the roller shafts 61A and 62A of the support rollers 61 and 62, before the roll sheet R is set thereon, to be held at the waiting position at which the roller shafts 61A and 62A are in contact with the upper ends of the guide holes 54 respectively.

Figure 13:
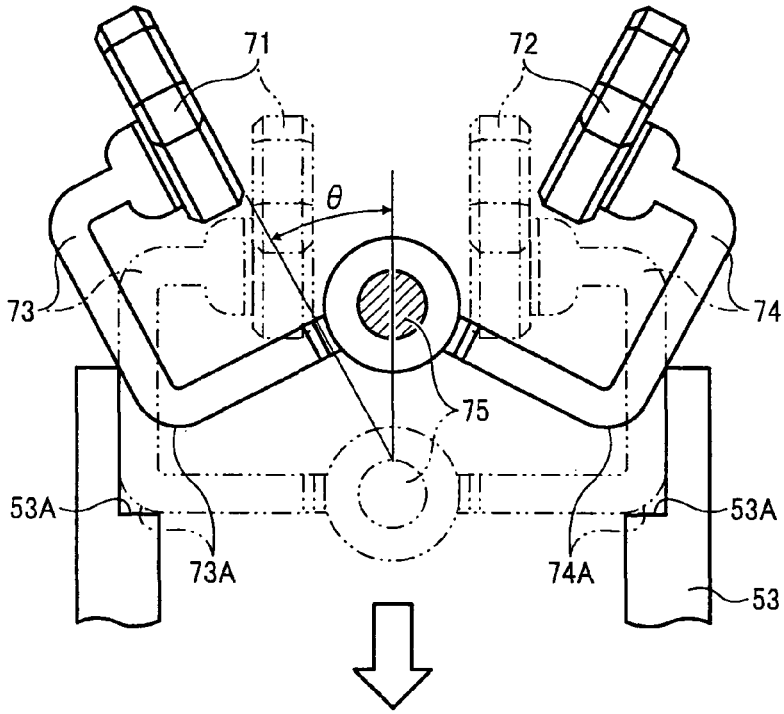
FIG. 13 is a schematic for explaining how brake plates according to the second embodiment move.

As shown in FIGS. 11 and 13, the load applying unit 70 includes a pair of brake plates 71 and 72 as a load applying member that applies rotational load to the flange 51. The brake plates 71 and 72 are fixed to one ends of nearly U-shaped arms 73 and 74, respectively. The other ends of the arms 73 and 74 are rotatably supported by a connecting shaft 75 that is formed so as to connect the roller holders 63 and 64 inside the receiving member 53. Therefore, because the roller holders 63 and 64 are pushed upward by the compression springs 65 and 66 before the roll sheet R is set and are thereby held at the waiting position, the brake plates 71 and 72 are held at a position, as indicated by the solid line in FIG. 13, where the arms 73 and 74 are open under their own weight and come into contact with the receiving member 53. An open angle θ at this time is preferably set to a position where the brake plates 71 and 72 do not interfere with the flange 51 placed from almost directly above.

In the roll-sheet feeding device 10 configured in the above manner, the support rollers 61 and 62 are located at the topmost position by the compression springs 65 and 66 as shown in FIG. 12 before the roll sheet R is set therein, and the brake plates 71 and 72 are open.

Figure 14:
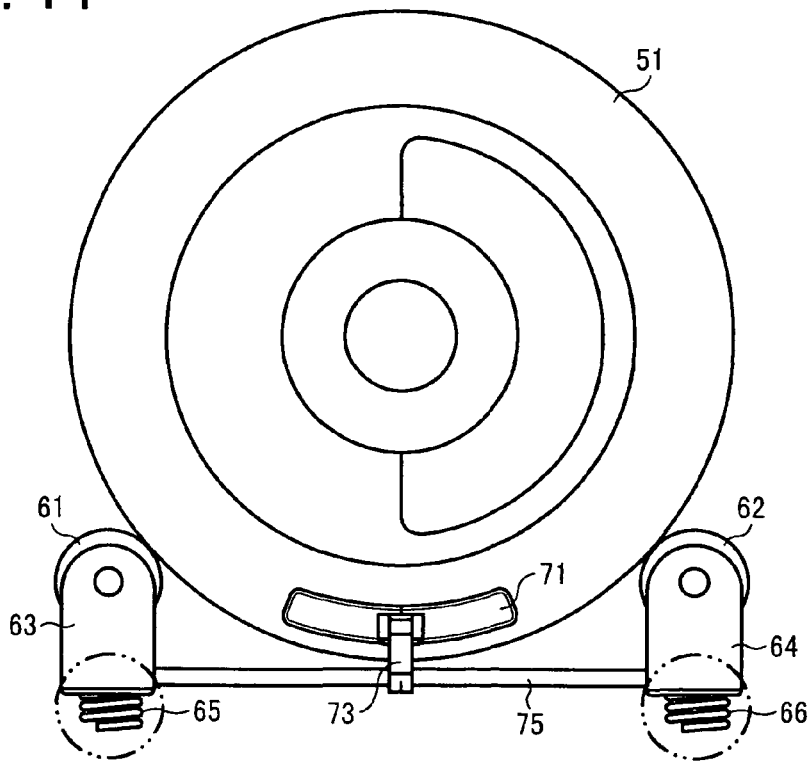
FIG. 14 is a schematic for explaining a supporting position of the roll-sheet feeding device according to the second embodiment.

Here, when the roll sheet R is set in the roll-sheet feeding device 10 and the flanges 51 thereof are inserted into the receiving members 53, each of the flanges 51 pushes the connecting shaft 75 of the arms 73 and 74 as shown in FIG. 14, and the roll sheet R is placed on the support rollers 61 and 62. The placed roll sheet R is held at a supporting position at which the weight of the roll sheet R is balanced with the compression springs 65 and 66. At this time, as indicated by dashed two-dotted lines in FIG. 13, corner portions 73A and 74A of the arms 73 and 74 touch step portions 53A provided on the walls of the receiving member 53, and the brake plates 71 and 72 move to the position of holding the flange 51 and applying rotational load thereto.

Thus, in the roll-sheet feeding device 10, the brake plates 71 and 72 move to the position of holding the flange 51 and applying the rotational load thereto only after the roll sheet R is set therein. When the roll sheet R is removed, the support rollers 61 and 62 return to the topmost position by the compression springs 65 and 66, and the brake plates 71 and 72 also return to the open state.

The roll-sheet feeding device 10 configured in the above manner enables the brake plates 71 and 72 to come into contact with the flange 51 at one action at which the roll sheet R is set in the receiving member 53, which allows improvement of operability. Moreover, because brake can be applied to the flange 51 from a lateral direction thereof, like a disk brake of automobiles, the roll sheet R can be prevented from sliding in a thrust direction, which allows stable sheet feeding in its radial direction.

Furthermore, when the brake is on the periphery of the flange 51, the roll sheet and the flange may jump due to its rebound in a sheet feeding direction. However, in the second embodiment, the brake is applied to the flange 51 from the lateral direction, and thus the flange 51 is held by the brake plates, which enables inconvenience such as jumping of the flange to be prevented.

Moreover, because the roll sheet R is getting lighter in weight by being used over time, the rotational load to be applied to the roll sheet R is preferably changed according to the weight. At this time, in the second embodiment, the height position of the connecting shaft 75 changes according to the weight of the roll sheet R, and this enables holding force of the brake plates 71 and 72 to be reduced as the weight of the roll sheet R becomes lighter. Thus, control can be provided so as to apply rotational load matching the weight of the roll sheet R.

If the brake plates 71 and 72 are fixed to the arms 73 and 74 respectively, the brake plates 71 and 72 may not come into surface-contact with the sides of the flange 51 but may possibly come into linear-contact therewith depending on each rotation angle of the arms 73 and 74. At this time, desired rotational load cannot be applied to the roll sheet R, and thus, the brake plates 71 and 72 are always required to come into surface-contact with the sides of the flange 51. Therefore, the brake plates 71 and 72 are fixed to the arms via an appropriate joint such as a universal joint so as to move on with the sides of the flange 51, although this is not shown in the second embodiment.

Figure 15:
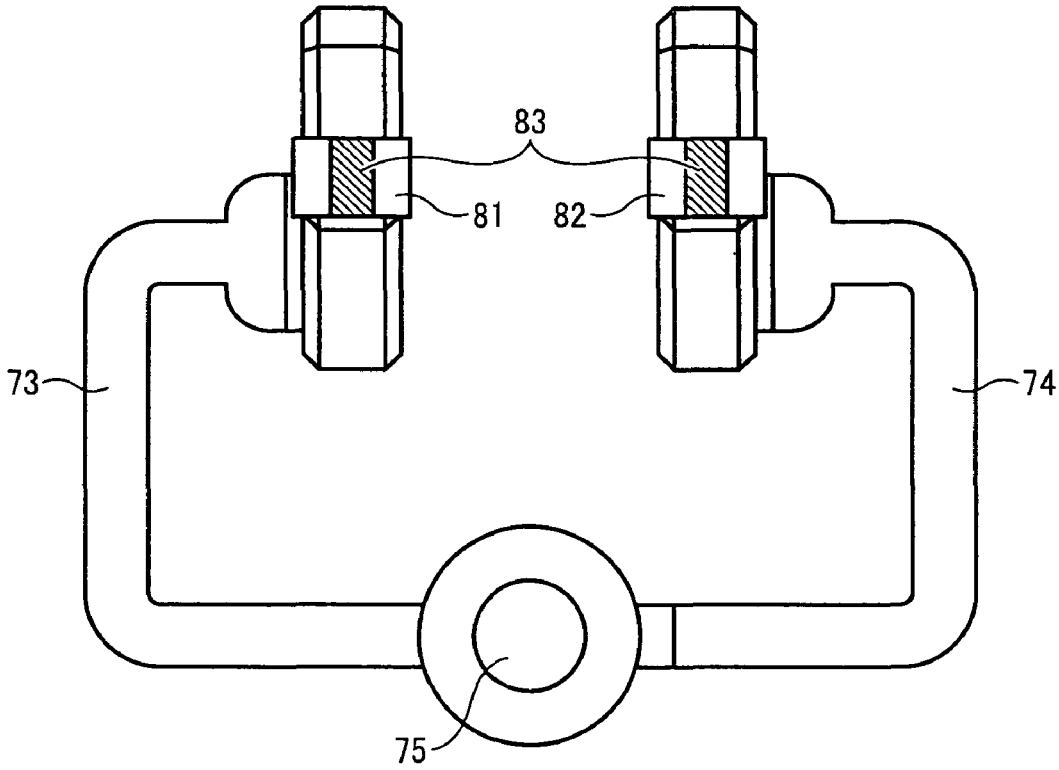
FIG. 15 is a schematic for explaining a modification of the roll-sheet feeding device according to the second embodiment.

The roll-sheet feeding device 10 requires the rotational load to the roll sheet R when it is fed, but it is preferable that the rotational load is not applied thereto when the roll sheet R is rewound. FIG. 15 is a schematic for explaining a modification of the roll-sheet feeding device according to the second embodiment. This modification includes brake rollers 81 and 82 that rotate following rotation of the flange 51, instead of a pair of the brake plates 71 and 72 as the load applying member. Fixed to the brake rollers 81 and 82 are one-way clutches 83 that do not follow a rotation of the flange 51 when the roll sheet R is fed but that follow the rotation thereof when the roll sheet R is rewound. With this feature, when the roll sheet R is fed, the one-way clutches 83 lock, and the outer peripheral surfaces of the brake rollers 81 and 82 apply rotational load to the sides of the flange 51. When the roll sheet R is rewound, the one-way clutches 83 are unlocked, and the brake rollers 81 and 82 thereby rotate, so that the carrying load of the motor can be reduced.

The exemplary embodiments of the present invention are explained so far, however, the present invention is not limited to these embodiments and various changes should be made.

For example, as the load applying member, not the brake plates 71 and 72 or the brake rollers 81 and 82, but a brake plate or a brake roller that comes into contact with only a one side i.e. only an external side of the flange 51 may be used. In this case, the size in the width direction of the roll can be made compact.

According to one aspect of the present invention, setting operability is excellent and it is also possible to prevent the setting of the roll sheet from being out of the set position due to jumping upon sheet feeding.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A roll-sheet feeding device that stores therein a roll sheet, rotates the roll sheet in an unwinding direction, and feeds the roll sheet, the roll-sheet feeding device comprising:

a supporting unit configured to rotatably support the roll sheet, the supporting unit including a circular member affixed to each of two sides of the roll sheet, the supporting unit and the circular member configured to allow the roll sheet to rotate in winding and unwinding directions when the roll sheet is set in a sheet feeding position;

a working member attached to the supporting unit, the working member configured to move from a waiting position to a holding position when the circular member contacts and applies a force on the working member as the roll sheet is moved onto the supporting unit and is set in the sheet feeding position, the working member configured to return to the waiting position from the holding position when the roll sheet is removed from the sheet feeding position; and a load applying unit attached to the working member and configured to apply a load to the circular member when the roll sheet is set in the sheet feeding position and the circular member rotates in at least the unwinding direction.

2. The roll-sheet feeding device according to claim 1, wherein the working member is formed in an arc shape and is swingably moved between the waiting position and the holding position by swinging through a support point of an intermediate area of the arc, the working member is provided at one end of the load applying unit, and a receiving portion that receives the circular member is provided at other end of the load applying unit.

3. The roll-sheet feeding device according to claim 2, wherein the arc of the working member is formed with a radius larger than a radius of the circular member, and the load applying unit and the receiving portion inwardly project from the arc of the working member.

4. The roll-sheet feeding device according to claim 2, wherein the receiving portion includes a guide member that guides the circular member to a receiving position.

5. The roll-sheet feeding device according to claim 1, wherein at the waiting position, the working member is located at a position in which the load applying unit is not in contact with the circular member of a roll sheet to be set, and the receiving portion is located at a position in which the circular member of the roll sheet to be set is received.

6. The roll-sheet feeding device according to claim 1, wherein the load applying unit includes structure configured to ensure that the load applied to the circular member by the load applying unit is greater as the circular member rotates in the unwinding direction as compared to the rewinding direction.

7. The roll-sheet feeding device according to claim 1, wherein the load applying unit includes structure that controls a magnitude of the load applied to the circular member by the load applying unit.

8. The roll-sheet feeding device according to claim 1, wherein, the supporting unit is configured to move between a sheet waiting position and a sheet supporting position by attaching and detaching the roll sheet through the circular member, and the load that the load applying unit is configured to apply is a rotational load force, the load applying unit includes a load applying member configured to contact a surface of the circular member when the roll sheet is set in the sheet feeding position.

9. The roll-sheet feeding device according to claim 8, wherein the sheet waiting position of the supporting unit is provided above the sheet supporting position, and an elastic force is biased by an elastic member in a direction in which the supporting unit is always kept at the sheet waiting position.

10. The roll-sheet feeding device according to claim 9, wherein the rotational load force of the load applying unit can be controlled by setting the elastic member.

11. The roll-sheet feeding device according to claim 8, wherein a height of the sheet supporting position of the supporting unit is displaced by a weight of the roll sheet that is supported thereby, and the load applying unit varies the rotational load force according to the height of the sheet supporting position of the supporting unit.

12. The roll-sheet feeding device according to claim 8, wherein the rotational load force of the load applying unit can be controlled by a weight of the circular member.

13. The roll-sheet feeding device according to claim 8, wherein the load applying member includes a pair of brake plates for holding the disk surface of the circular member.

14. The roll-sheet feeding device according to claim 8, wherein the load applying member includes a brake roller with a one-way clutch that locks when the roll sheet is fed and is unlocked when the roll sheet is rewound.

15. An image forming apparatus comprising the roll-sheet feeding device according to claim 8.

16. An image forming apparatus comprising the roll-sheet feeding device according to claim 1.

* * * * *